US006192705B1

(12) United States Patent
Kimble, III

(10) Patent No.: US 6,192,705 B1
(45) Date of Patent: Feb. 27, 2001

(54) RELIQUEFACTION OF PRESSURIZED BOIL-OFF FROM PRESSURIZED LIQUID NATURAL GAS

(75) Inventor: E. Lawrence Kimble, III, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/422,457

(22) Filed: Oct. 21, 1999

Related U.S. Application Data

(60) Provisional application No. 60/105,325, filed on Oct. 23, 1998.

(51) Int. Cl.[7] ..... F25J 1/00

(52) U.S. Cl. ..... 62/613; 62/619; 62/623; 62/48.2

(58) Field of Search ..... 62/613, 619, 623, 62/48.2

(56) References Cited

U.S. PATENT DOCUMENTS

| | | | |
|---|---|---|---|
| 3,298,805 | 1/1967 | Secord et al. | 48/190 |
| 3,433,026 | 3/1969 | Swearingen | 62/23 |
| 3,477,509 | 11/1969 | Arendt | 166/252 |
| 3,677,019 | 7/1972 | Olszewski | 62/9 |
| 3,724,226 | 4/1973 | Pachaly | 62/39 |
| 3,733,838 | 5/1973 | Delahunty | 62/54 |
| 3,735,600 | 5/1973 | Dowdell et al. | 62/39 |
| 3,857,245 | 12/1974 | Jones | 60/651 |
| 3,874,185 | 4/1975 | Etzbach | 62/40 |
| 3,919,852 | 11/1975 | Jones | 62/7 |
| 3,990,256 | 11/1976 | May et al. | 62/53 |
| 4,157,904 | 6/1979 | Campbell et al. | 62/27 |
| 4,187,689 | 2/1980 | Selcukoglu et al. | 62/54 |
| 4,192,655 | 3/1980 | von Linde | 48/191 |
| 4,315,407 | 2/1982 | Creed et al. | 62/53 |
| 4,320,303 | 3/1982 | Ooka et al. | 290/1 R |
| 4,456,459 | 6/1984 | Brundige, Jr. | 62/9 |
| 4,541,852 | 9/1985 | Newton et al. | 62/11 |
| 4,548,629 | 10/1985 | Chiu | 62/17 |
| 4,638,639 | 1/1987 | Marshall et al. | 62/9 |
| 4,687,499 | 8/1987 | Aghili | 62/24 |
| 4,689,962 | 9/1987 | Lofredo | 62/54 |
| 4,698,081 | 10/1987 | Aghili | 62/24 |
| 4,718,459 | 1/1988 | Adorjan | 138/105 |
| 4,727,723 | 3/1988 | Durr | 62/54 |
| 4,778,497 | 10/1988 | Hanson et al. | 62/11 |
| 4,843,829 | 7/1989 | Stuber et al. | 62/54 |

(List continued on next page.)

FOREIGN PATENT DOCUMENTS

| | | |
|---|---|---|
| WO 97/01069 | 9/1997 | (WO) . |
| WO 97/13109 | 10/1997 | (WO) . |

OTHER PUBLICATIONS

Bennett, C. P. Marine Transportation of LNG at Intermediate Ttemperature, *CME* (Mar. 1979), pp. 63–64.

(List continued on next page.)

*Primary Examiner*—Ronald Capossela
(74) *Attorney, Agent, or Firm*—Gary D. Lawson

(57) ABSTRACT

A process is disclosed for reliquefying boil-off gas produced by pressurized liquid natural gas. In this process, refrigeration duty is provided to a heat exchanger by means of a refrigeration cycle. Pressurized natural gas is cooled by the heat exchanger and then expanded to a lower pressure to produce a liquid stream that is passed to a first phase separator. A boil-off vapor is passed through the heat exchanger and it is then compressed and cooled before being recycled back through the heat exchanger. The compressed, cooled boil-off gas is then expanded and passed to a second phase separator. A vapor stream produced by the second separator is removed from the process. A liquid stream produced by the second phase separator is passed to the first phase separator to produce a pressurized liquid having a temperature above about −112° C. and a pressure sufficient for the liquid to be at or below its bubble point.

6 Claims, 1 Drawing Sheet

U.S. PATENT DOCUMENTS

| | | | | |
|---|---|---|---|---|
| 4,846,862 | | 7/1989 | Cook | 62/9 |
| 5,006,138 | | 4/1991 | Hewitt | 62/18 |
| 5,036,671 | | 8/1991 | Nelson et al. | 62/23 |
| 5,076,822 | | 12/1991 | Hewitt | 62/18 |
| 5,199,266 | | 4/1993 | Johansen | 62/8 |
| 5,363,655 | | 11/1994 | Kikkawa et al. | 62/9 |
| 5,372,010 | | 12/1994 | Gratz | 62/87 |
| 5,442,934 | | 8/1995 | Wolflick | 62/401 |
| 5,473,900 | | 12/1995 | Low | 62/9 |
| 5,524,456 | * | 6/1996 | Stokes | 62/48.2 |
| 5,615,561 | | 4/1997 | Houshmand et al. | 62/611 |
| 5,651,269 | | 7/1997 | Prevost et al. | 62/613 |
| 5,669,234 | | 9/1997 | Houser et al. | 62/612 |
| 5,755,114 | | 5/1998 | Foglietta | 62/618 |
| 5,802,874 | | 9/1998 | Voit | 62/650 |
| 5,829,269 | * | 11/1998 | Pecoud et al. | 62/48.2 |
| 5,836,173 | | 11/1998 | Lynch et al. | 62/613 |
| 5,878,814 | | 3/1999 | Breivik et al. | 166/267 |
| 5,950,453 | | 9/1999 | Bowen et al. | 62/612 |
| 5,956,971 | | 9/1999 | Cole et al. | 62/623 |

OTHER PUBLICATIONS

Broeker, R. J. CNG and MLG–New Natural Gas Transportation Processes, *American Gas Journal* (Jul. 1969) pp. 138–140.

Faridany, E. K., Ffooks, R. C., and Meikle, R. B. A Pressure LNG System, *European Offshore Petroleum Conference & Exhibition* (Oct. 21–24, 1980), vol. EUR 171, pp. 245–254.

Faridany, E. K., Secord, H.C, O'Brien, J. V., Pritchard, J.F., and Banister, M. The Ocean Phoenix Pressure–LNG System, *GASTECH 76* (1976), New York, pp. 267–280.

Fluggen, Prof. E. and Backhaus, Dr. I.H. Pressurised LNG—and the Ultisation of Small Gas Fields, *GASTECH78, LNG/LPG Conference* (Nov. 7, 1978), Monte Carlo pp. 195–204.

Gas Processors Suppliers Association. Turboexpanders, *Engineering Data Book* (1987), vol. I, Sec. 1–16, pp. 13–40:13–41.

Lynch, J. T. and Pitman, R. N. Improving Thoughput and Ethane Recovery at GPM's Goldsmith Gas Plant, *Proceedings of the Seventy–Fifth Gas Processors Association Annual Convention*, (Mar. 11–13, 1996), Denver, Colorado, pp. 210–217.

Lynch, J. T. and Pitman, R. N. Texas Plant Retrofit Improves Through $C_2$ Recovery, *Oil and Gas Journal* (Jun. 3, 1996), pp. 41–48.

Maddox, R. N., Sheerar, L. F., and Erbar, J. H. Cryogenic Expander Processing, *Gas Conditioning and Processing* (Jan. 1982) vol. 3, 13–9:13–10.

Perret, J. Techniques in the Liquefaction of Natural Gas, *French Natural Gas*, (Nov. 11, 1996), pp. 1537–1539.

Petsinger, R. E. LNG on the Move, *GAS*, (Dec. 1967), pp. 45–59.

Broeker, R. J. A New Process for the Transportation of Natural Gas, *Proceedings of the First International Conference on LNG* (1968), Chicago, Illinois, Session No. 5, Paper 30, pp. 1–11.

Ladkany, S. G. Composite Aluminum–Fiberglass Epoxy Pressure Vessels for Transportation of LNG at Intermediate Temperature, published in *Advances in Cryogenic Engineering, Materials, vol. 28*, (*Proceedings of the 4th International Cryogenic Materials Conference*), San Diego, CA, USA, Aug. 10–14, 1981, pp. 905–913.

* cited by examiner

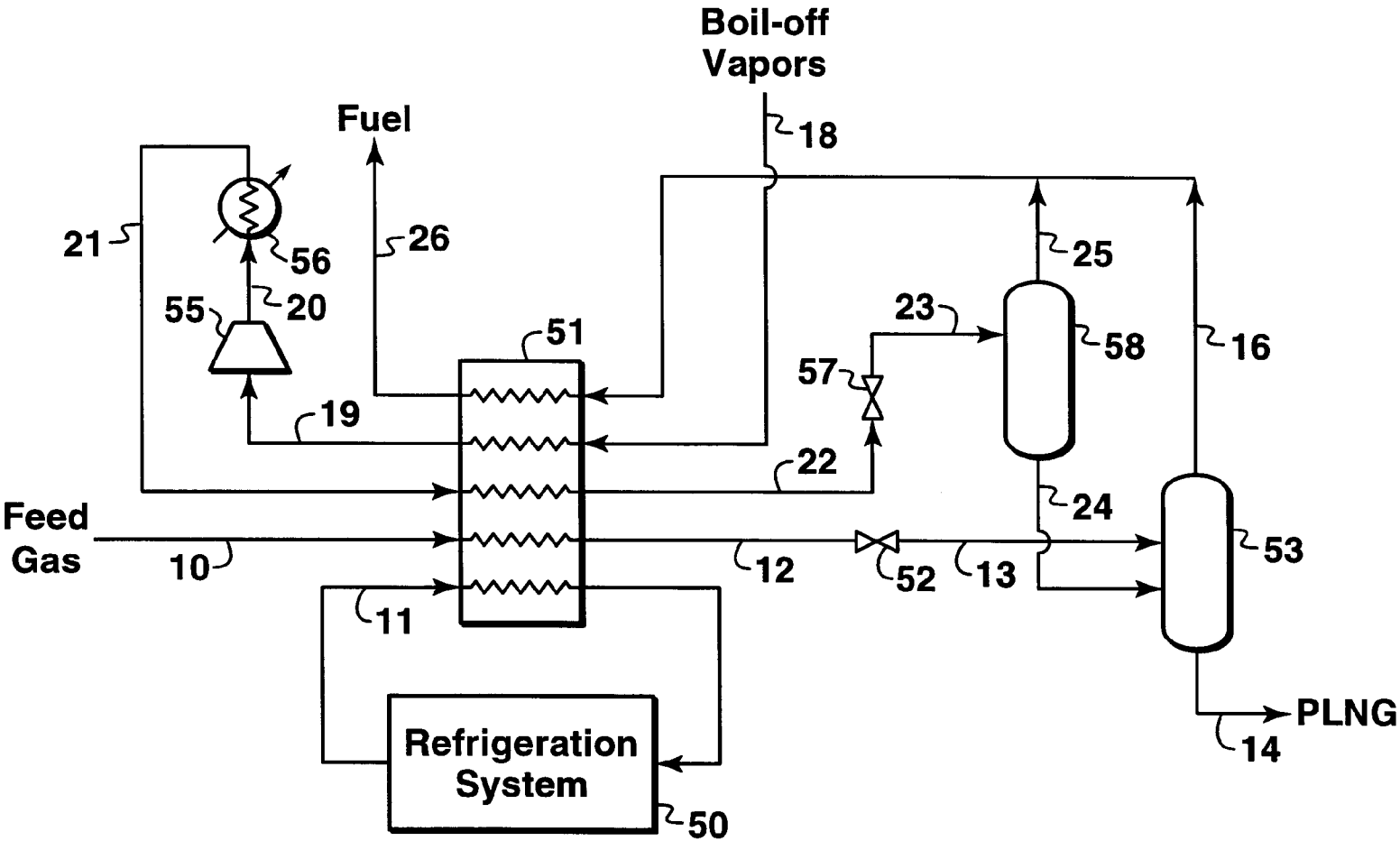
Boil-off Vapors
18
16
53
PLNG
14
25
58
24
23
13
52
57
22
12
51
50
Refrigeration System
Fuel
26
11
19
56
20
55
10
21
Feed Gas

RELIQUEFACTION OF PRESSURIZED BOIL-OFF FROM PRESSURIZED LIQUID NATURAL GAS

This application claims the benefit of U.S. Provisional Application No. 60/105,325, filed Oct. 23, 1998.

FIELD OF THE INVENTION

This invention relates generally to an improved process for reliquefaction of pressurized boil-off gas from pressurized liquefied natural gas.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

LNG refrigeration systems are expensive because so much refrigeration is needed to liquefy natural gas. A typical natural gas stream enters a LNG plant at pressures from about 4,830 kPa (700 psia) to about 7,600 kPa (1,100 psia) and temperatures from about 20° C. to about 40° C. Natural gas, which is predominantly methane, cannot be liquefied by simply increasing the pressure, as is the case with heavier hydrocarbons used for energy purposes. The critical temperature of methane is −82.5° C. This means that methane can only be liquefied below that temperature regardless of the pressure applied. Since natural gas is a mixture of gases, it liquefies over a range of temperatures. The critical temperature of natural gas is typically between about −85° C. and −62° C. Natural gas compositions at atmospheric pressure will typically liquefy in the temperature range between about −165° C. and −155° C. Since refrigeration equipment represents such a significant part of the LNG facility cost, considerable effort has been made to reduce refrigeration costs.

Many systems exist in the prior art for the liquefaction of natural gas by sequentially passing the gas at an elevated pressure through a plurality of cooling stages whereupon the gas is cooled to successively lower temperatures until the gas liquefies. Conventional liquefaction cools the gas to a temperature of about −160° C. at or near atmospheric pressure. Cooling is generally accomplished by heat exchange with one or more refrigerants such as propane, propylene, ethane, ethylene, and methane. Although many refrigeration cycles have been used to liquefy natural gas, the three types most commonly used in LNG plants today are: (1) "cascade cycle" which uses multiple single component refrigerants in heat exchangers arranged progressively to reduce the temperature of the gas to a liquefaction temperature, (2) "expander cycle" which expands gas from a high pressure to a low pressure with a corresponding reduction in temperature, and (3) "multi-component refrigeration cycle" which uses a multi-component refrigerant in specially designed exchangers. Most natural gas liquefaction cycles use variations or combinations of these three basic types.

One proposal for reducing refrigeration costs is to produce liquefied natural gas at temperatures above −112° C. (−170° F.) and a pressure sufficient for the liquid to be at or below its bubble point. This pressurized liquid natural gas is referred to as PLNG to distinguish it from LNG which is at or near atmospheric pressure. PLNG requires significantly less refrigeration since PLNG can be more than 50° C. warmer than conventional LNG. For most natural gas compositions, the pressure of the PLNG ranges between about 1,380 kPa (200 psia) and about 3,450 kPa (500 psia). In the storage, transportation, and handling of PLNG, there can be a considerable amount of "boil-off." A needs exist for a process for re-liquefying PLNG boil-off gas to again produce PLNG and at the same time having power requirements that are economic.

SUMMARY

This invention relates to a process for reliquefying pressurized boil-off gas produced by pressurized liquid natural gas. In this process, refrigeration duty is provided to a heat exchanger by means of a refrigeration cycle, preferably a closed-cycle refrigeration system have mixed refrigerants as the cooling medium. Pressurized natural gas is fed through the heat exchanger, which at least partially liquefies the natural gas. The natural gas is then expanded to a lower pressure to produce a liquid stream having a temperature above about −112° C. (−170° F.) and having a pressure sufficient for the liquefied stream to be at or below its bubble point. The liquid stream is then passed to a first phase separator to remove from the liquid stream any vapors that may exist after the expansion step. A boil-off vapor to be reliquefied is passed through the heat exchanger, thereby providing refrigeration duty to the heat exchanger for cooling the feed natural gas and warming the incoming boil-off gas. The boil-off gas is then compressed and cooled before being recycled back through the heat exchanger for further cooling of the boil-off gas. The compressed, cooled boil-off gas is then expanded to a lower pressure and passed to a second phase separator. The second phase separator produces a vapor stream and a liquid stream. The vapor stream produced by the second separator is removed from the process for further use preferably as pressurized fuel, and more preferably the removal for use as fuel occurs after the vapor stream has passed through the heat exchanger for warming of fuel. The liquid stream produced by the second phase separator is passed to the first phase separator to produce a pressurized product stream having a temperature above about −112° C. and a pressure sufficient for the liquid to be at or below its bubble point.

An advantage of this process is that vapors produced by loading of ships and other storage containers with PLNG can be liquefied with minimal recompression of the vapors. This process also reduces the total compression required by the recovering for use as fuel a portion of the vapor to be reliquefied. This is advantageous since the vapor portion removed as fuel contains a significantly higher concentration of nitrogen than the nitrogen concentration in the liquefied gas product. Removal of nitrogen from the process in accordance with this invention requires up to seven percent less overall compression for the liquefaction plant than would be required if the nitrogen was not removed and all of the vapor was liquefied.

BRIEF DESCRIPTION OF THE DRAWING

The present invention and its advantages will be better understood by referring to the following detailed description and the attached drawing, which is a simplified flow diagram of one embodiment of this invention illustrating a process for reliquefaction of boil-off gas from PLNG. This flow diagram presents a preferred embodiment of practicing the process of this invention. The drawing is not intended to exclude from the scope of the invention other embodiments that are the result of normal and expected modifications of this specific embodiment. Various required subsystems such as valves, flow stream mixers, control systems, and sensors have been deleted from the drawing for the purposes of simplicity and clarity of presentation.

DESCRIPTION OF THE INVENTION

A natural gas liquefaction process has been discovered that liquefies a pressurized natural gas stream and at the same time liquefies boil-off gas generated from a pressurized liquid natural gas. This invention is particularly well suited for reliquefaction of boil-off from liquid natural gas having a temperature above about −112° C. (−170° F.) and a pressure sufficient for the liquefied stream to be at or below its bubble point, which is referred to in this description as "PLNG."

The process of this invention is also will suited for liquefying boil-off gas generated from PLNG that contains nitrogen. If PLNG contains nitrogen, the boil-off gas from the PLNG will typically contain a higher concentration of nitrogen. The primary source of nitrogen impurity in the boil-off vapor is the nitrogen in the PLNG. Nitrogen, more volatile than liquefied natural gas, flashes off preferentially and concentrates within the boil-off vapor. For example, PLNG containing 0.3 mole percent $N_2$ can produce a vapor containing approximately 3 mole percent $N_2$. At the higher temperatures and pressure of PLNG, the nitrogen flashes off even more preferentially than conventional liquefied natural gas at or near atmospheric pressure. The process of this invention reliquefies boil-off vapor having a relatively high nitrogen composition to produce PLNG having a relatively low nitrogen composition.

The term "bubble point" as used in this description of the invention is the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, PLNG is saturated liquid. It is preferred that the PLNG is not just condensed to its bubble point, but further cooled to subcool the liquid. Subcooling the PLNG reduces the amount of boil-off vapors during its storage, transportation and handling.

The first consideration in cryogenic processing of natural gas is contamination. The raw natural gas feed stock suitable for the process of this invention may comprise natural gas obtained from a crude oil well (associated gas) or from a gas well (non-associated gas). The composition and pressure of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, butane, hydrocarbons of six or more carbon atoms, dirt, iron sulfide, wax, and crude oil. The solubilities of these contaminants vary with temperature, pressure, and composition. At cryogenic temperatures, $CO_2$, water, and other contaminants can form solids, which can plug flow passages in cryogenic heat exchangers. These potential difficulties can be avoided by removing such contaminants if conditions within their pure component, solid phase temperature-pressure phase boundaries are anticipated. In the following description of the invention, it is assumed that the natural gas stream has been suitably treated to remove sulfides and carbon dioxide and dried to remove water using conventional and well-known processes to produce a "sweet, dry" natural gas stream. If the natural gas stream contains heavy hydrocarbons which could freeze out during liquefaction or if the heavy hydrocarbons are not desired in the PLNG, the heavy hydrocarbon may be removed by a fractionation process prior to or as part of the liquefaction process described below.

The process of this invention will now be described with reference to the flow diagram illustrated in FIG. 1. A natural gas feed stream 10 enters the liquefaction process at a pressure above about 1,380 kPa (200 psia) and more preferably above about 2,400 kPa (350 psia) and temperatures preferably above about −112° C. (−170° F.) and still more preferably above about −94° C. (−138° F.); however, different pressures and temperatures can be used, if desired, and the system can be appropriately modified accordingly. If the gas stream 10 is below about 1,380 kPa (200 psia), it can be pressurized by a suitable compression means (not shown), which may comprise one or more compressors.

Feed stream 10 is passed through heat exchanger 51 to liquefy the natural gas. The heat exchanger 51 may comprise one or more stages cooled by a conventional cooling system 50. For example, the cooling system 50 can comprise a single or multi-component refrigeration system having propane, propylene, ethane, carbon dioxide, or any other suitable liquid as a refrigerant. Refrigeration system 50 is preferably a closed-loop multi-component refrigeration system which is a well known means of cooling by indirect heat exchange. The term "indirect heat exchange," as used in this description, means the bringing of two fluid streams into heat exchange relation without any physical contact or intermixing of the fluids with each other.

This invention is not limited to any type of heat exchanger 51, but because of economics, plate-fin exchangers and spiral wound, and cold box heat exchangers are preferred, which all cool by indirect heat exchange. The optimal refrigeration system 50 and heat exchanger 51 can be determined by those having ordinary skill in the art taking into account the flow rate and compositions of fluids passing through the heat exchanger 51.

Liquefied natural gas stream 12 exiting heat exchanger 51 is passed through one or more expansion means, such as an expansion valve 52. This isenthalpic reduction in pressure results in the flash evaporation of a minor gas fraction, liquefaction of the balance of the natural gas, and the overall reduction in temperature of both the minor gas fraction and the remaining major liquid fraction. To produce a PLNG product in accordance with the practice of this invention, the temperature of the natural gas in stream 13 is preferably above about −112° C. Flow stream 13 is passed to a phase separator 53 which produces a liquid product stream 14 which is PLNG having a temperature above about −112° C. (−170° F.) and a pressure sufficient for the liquid product to be at or below its bubble point. The PLNG is passed to a suitable storage means (not shown in FIG. 1) such as a stationary storage tank or a carrier such as a PLNG ship, truck, or railcar. For the liquid product to remain in a liquid phase, the temperature must be below the critical temperature for the product, which will typically be below −62° C. (−80° F.). The phase separator 53 will typically produce minor fractions of vapor stream 16, which may be removed from the process as fuel. Preferably, vapor stream 16 is heated in heat exchanger 51 before being used as fuel (stream 26).

Boil-off vapor resulting from evaporation during the storage, transportation, and handling (not shown in FIG. 1) of liquefied natural gas is introduced to the process of this invention as stream 18. The temperature of the boil-off gas generated by PLNG will typically be above about −112° C. (−170° F.) and the pressure will typically be above about 1,380 kPa (200 psia). The boil-off gas stream 18 can contain up to 3% nitrogen.

The boil-off gas is passed through heat exchanger 51 which warms the boil-off gas well above cryogenic temperatures. The heat exchanger captures the cold energy of the boil-off gas before it is pressurized. After exiting heat exchanger 51, the boil-off gas (stream 19) is compressed by compressor 55. In the practice of this invention, since incoming boil-off gas of stream 18 is pressurized, the power requirements of compressor 55 is minimal since the compressor will boost the pressure of the boil-off gas to a pressure above the pressure of product stream 14, preferably between about 20 and about 150 psia above the pressure of the product stream 14, and more preferably between about 40 and about 50 pounds above the pressure of product stream 14. The power required to obtain this compression is substantially less than the power that would be required in a conventional process (not shown in the drawings) for re-liquefying boil-off gas in which the boil-off gas is compressed to the pressure of feed stream 10 and then combined with the feed stream 10.

The compressor is shown in FIG. 1 as a single unit, which in most applications will be sufficient. It is understood, however, that in the practice of this invention a plurality of stages (e. g. , three with two intercoolers) can be used. Also an after-cooler positioned down stream from the last compression stage is used. In FIG. 1, only one after-cooler 56 is shown, preferably using ambient air or water as the cooling medium.

After exiting after-cooler 56, the compressed boil-off gas (stream 21) is passed back through the heat exchanger 51 to further cool the boil-off gas. From the heat exchanger 51, the boil-off gas is passed (stream 22) through an expansion means, such as Joule-Thomson valve 57 to further reduce the temperature of the boil-off gas. This isenthalpic reduction in pressure results in the flash evaporation of a gas fraction, liquefaction of the balance of the boil-off gas, and the overall reduction in temperature of both the boil-off gas fraction and the remaining liquid fraction. To produce a high pressure liquid natural gas product from the boil-off gas in accordance with the practice of this invention, the temperature of the natural gas in stream 23 is preferably above about −112° C. and the pressure is preferably approximately the same pressure as stream 13. Flow stream 23 is passed to phase separator 58 which produces a liquid product stream 24, a pressurized liquid natural gas having a temperature above about −112° C. (−170° F.), which is passed to phase separator 53.

Also withdrawn from phase separator 58 is a vapor stream 25 rich in methane and containing an appreciable quantity of nitrogen. This vapor stream is mixed with the vapor stream 16 for use as pressurized fuel. The outlet temperatures of streams 12 and 22 are controlled to match the amount of uncondensed vapor volume (stream 25) with the fuel needs of the liquefaction plant. The volume of stream 25 increases with increases in the temperature of stream 22. If the fuel requirements of the plant are low, the temperature of stream 22 as well as stream 12 can be lowered. The regulation of heat exchanger 51 to achieve a desired volume of stream 25 can be determined by those skilled in the art in light of the teachings of this description.

EXAMPLE

A simulated mass and energy balance was carried out to illustrate the embodiment illustrated in FIG. 1, and the results are set forth in the Table below. The data were obtained using a commercially available process simulation program called HYSYS™ (available from Hyprotech Ltd. of Calgary, Canada); however, other commercially available process simulation programs can be used to develop the data, including for example HYSIM™, PROII™, and ASPEN PLUS™, which are familiar to those of ordinary skill in the art. The data presented in the Table are offered to provide a better understanding of the embodiment shown in FIG. 1, but the invention is not to be construed as unnecessarily limited thereto. The temperatures and flow rates are not to be considered as limitations upon the invention which can have many variations in temperatures and flow rates in view of the teachings herein.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

TABLE 1

| Stream | Phase | Pressure psia | Pressure kPa | Temp ° F. | Temp ° C. | Flow lbmole/hr X1000 | Flow kgmole/hr X1000 | Composition $C_1$ mole % | Composition $N_2$ mole % |
|---|---|---|---|---|---|---|---|---|---|
| 10 | Vapor | 1234 | 8515 | 39 | 3.9 | 224.4 | 101.8 | 97 | 0.73 |
| 12 | Liquid | 1204 | 8515 | −139.3 | −95.2 | 224.4 | 101.8 | 97 | 0.73 |
| 13 | Liquid | 410 | 2827 | −146.2 | −99 | 224.4 | 101.8 | 97 | 0.73 |
| 14 | Liquid | 410 | 2827 | −146.2 | −99 | 224.4 | 101.8 | 97 | 0.73 |
| 16 | | | | | | 0 | 0 | | |
| 18 | Vapor | 385.5 | 2658 | −138 | −94.4 | 16.6 | 7.5 | 97.2 | 1.8 |
| 19 | Vapor | 382.5 | 2637 | 31.7 | −0.2 | 16.6 | 7.5 | 97.2 | 1.8 |
| 20 | Vapor | 500 | 3448 | 74.6 | 23.7 | 16.6 | 7.5 | 97.2 | 1.8 |
| 21 | Vapor | 490 | 3379 | 52 | 11.1 | 16.6 | 7.5 | 97.2 | 1.8 |
| 22 | Vapor/ | 460 | 3172 | −139.3 | −95.2 | 16.6 | 7.5 | 97.2 | 1.8 |

TABLE 1-continued

| Stream | Phase | Pressure psia | Pressure kPa | Temp ° F. | Temp ° C. | Flow lbmole/hr X1000 | Flow kgmole/hr X1000 | Composition $C_1$ mole % | Composition $N_2$ mole % |
|---|---|---|---|---|---|---|---|---|---|
| 23 | Liquid Vapor/ Liquid | 410 | 2827 | −145.3 | −98.5 | 16.6 | 7.5 | 97.2 | 1.8 |
| 24 | Liquid | 410 | 2827 | −145.3 | −98.5 | 10.7 | 4.9 | 97.5 | 1.1 |
| 25 | Vapor | 410 | 2827 | −145.3 | 5.9 | 2.7 | 96.6 | 3.2 | |
| 26 | Vapor | 407 | 2806 | 37 | 3.8 | 5.9 | 2.7 | 96.6 | 3.2 |

What is claimed is:

1. A process for reliquefying pressurized boil-off gas produced by pressurized liquid natural gas, comprising the steps of:

(a) providing refrigeration duty to a heat exchanger by means of a refrigeration cycle;

(b) passing pressurized natural gas through the heat exchanger to cool the natural gas, said pressurized natural gas being warmer than the pressurized boil-off gas;

(c) expanding the cooled natural gas to a lower pressure, thereby liquefying at least part of the cooled natural gas, the liquefied gas having a temperature above about −112° C. (−170° F.) and a pressure sufficient for the liquefied gas to be at or below its bubble point;

(d) separating in a first phase separator any vapor phase, if a vapor phase exists after the expansion of step (c), from the liquefied gas;

(e) warming in the heat exchanger the boil-off gas to be reliquefied, thereby providing refrigeration duty to the heat exchanger;

(f) compressing and cooling the warmed boil-off gas;

(g) returning the compressed boil-off gas to the heat exchanger to further cool the compressed boil-off gas;

(h) expanding the compressed boil-off gas to a lower pressure to produce a gas phase and a liquid phase;

(i) phase separating in a second phase separator the gas phase and the liquid phase of step (h);

(j) passing the liquid phase of step (i) to the first phase separator;

(k) recovering vapors from the second phase separator; and (l) withdrawing liquid from the first phase separator as pressurized liquid natural gas having a temperature above about −112° C. (−170° F.) and a pressure sufficient for the liquid to be at or below its bubble point.

2. The process of claim 1 further comprises the step of passing recovered vapor of step (k) through the heat exchanger.

3. The process of claim 1 further comprises producing a predetermined amount of vapor recovered in step (k) by regulating the amount of cooling of the boil-off gas in its passage through the heat exchanger.

4. The process of claim 1 wherein the boil-off gas introduced to the process has as temperature above −112° C. (−170° F.) and a pressure above 1,379 kPa.

5. The process of claim 4 wherein the boil-off gas has a pressure above 2,413 kPa.

6. A process for reliquefying nitrogen-containing boil-off gas from a vessel containing pressurized liquid natural gas having a temperature above about −112° C. (−170° F.) and a pressure sufficient for the liquefied stream to be at or below its bubble point, comprising the steps of:

(a) circulating a refrigerant in a closed circuit through a heat exchanger;

(b) passing pressurized natural gas through the heat exchanger to cool the natural gas;

(c) expanding the cooled natural gas to a lower pressure to produce liquefied gas;

(d) separating in a first phase separator any vapor phase, if a vapor phase exists after the expansion of step (c), from the liquefied gas;

(e) warming the boil-off gas to be reliquefled in the heat exchanger, thereby providing refrigeration duty to the heat exchanger;

(f) compressing and cooling the warmed boil-off gas;

(g) returning the compressed boil-off gas to the heat exchanger to further cool the compressed gas;

(h) expanding the compressed boil-off gas to a lower pressure to produce a gas phase and a liquid phase;

(i) phase separating in a second phase separator the gas phase and the liquid phase of step (h);

(j) passing the liquid phase of step (i) to the first phase separator;

(k) withdrawing vapors containing nitrogen from the second phase separator; and (l) withdrawing liquid from the first phase separator as pressurized liquid natural gas having a temperature above about −112° C. and a pressure sufficient for the liquid to be at or below its bubble point.

* * * * *